US012692049B2

(12) United States Patent
Bi

(10) Patent No.: US 12,692,049 B2
(45) Date of Patent: Jul. 28, 2026

(54) FUEL CAN

(71) Applicant: Tangshan Saidisi Metal Packaging Co., Ltd., Tangshan (CN)

(72) Inventor: Xiaofei Bi, Tangshan (CN)

( * ) Notice: Subject to any disclaimer, the term of this patent is extended or adjusted under 35 U.S.C. 154(b) by 4 days.

(21) Appl. No.: 18/927,612

(22) Filed: Oct. 29, 2024

(65) Prior Publication Data

US 2025/0333212 A1 Oct. 30, 2025

(30) Foreign Application Priority Data

Apr. 26, 2024 (CN) ..... 202420883997.9

(51) Int. Cl.
*B65D 41/42* (2006.01)

(52) U.S. Cl.
CPC ..... *B65D 41/425* (2013.01); *B65D 2401/15* (2020.05)

(58) Field of Classification Search
CPC ... B65D 41/425; B65D 51/18; B65D 2401/15
USPC ..... 215/256, 231; 220/258.2
See application file for complete search history.

(56) References Cited

U.S. PATENT DOCUMENTS 1,467,578 A * 9/1923 Gianini ..... B65D 51/18 215/231
1,836,220 A * 12/1931 Bloom ..... B65D 43/022 229/5.5
3,342,611 A * 9/1967 Hunter, Jr. ..... B65D 51/28 426/632
4,850,858 A * 7/1989 Blankenship ..... F23D 3/08 126/45
5,193,521 A * 3/1993 Levinson ..... F23D 3/08 126/45
5,302,114 A * 4/1994 Kiefer ..... A47J 36/24 431/298
5,307,799 A * 5/1994 Scarnato ..... F23D 3/08 126/45
5,405,262 A * 4/1995 Appel ..... F23D 3/08 126/45
6,047,878 A * 4/2000 Lowry ..... B65D 3/262 229/125.05
6,220,471 B1 * 4/2001 Lowry ..... B65D 43/0208 220/780
8,132,578 B2 * 3/2012 LoPrete ..... A45D 33/025 206/823

(Continued)

FOREIGN PATENT DOCUMENTS

CN 2591422 Y 12/2003
CN 216408548 U 4/2022

*Primary Examiner* — Orlando E Aviles
*Assistant Examiner* — Niki M Eloshway

(57) ABSTRACT

A fuel can includes a can body, the can body contains liquid fuel and a wick with its lower end immersed in the liquid fuel, and a top cover is provided at a top of the can body. The top cover includes a ring-pull cap and a sealing cap, the ring-pull cap consists of an outer ring and a tear-off piece, the outer ring is connected to an upper opening of the can body in a sealing manner, and the sealing cap is buckled at a top end of the outer ring; a tray is provided at an upper end of the can body, and a periphery of the tray is connected to an inner wall of the can body in a sealing manner, and at least one fixing mouth for fixing the upper end of the wick provided in a middle of the tray.

5 Claims, 3 Drawing Sheets

(56) References Cited

U.S. PATENT DOCUMENTS

| | | | | |
|---|---|---|---|---|
| 2006/0266751 | A1* | 11/2006 | Ali | B65D 81/3453<br>220/780 |
| 2007/0062947 | A1* | 3/2007 | Lin | B65D 81/2038<br>220/366.1 |
| 2011/0097676 | A1* | 4/2011 | Masterson | F23D 14/78<br>431/320 |

* cited by examiner

FUEL CAN

CROSS-REFERENCE TO RELATED APPLICATIONS

This application claims the priority of Chinese Patent Application No. CN 2024208839979, filed on Apr. 26, 2024, entitled "Fuel Can", the entirety of which is incorporated by reference herein.

TECHNICAL FIELD

The present application pertains to the technical filed of fuel appliances, in particular to a fuel can.

BACKGROUND

People cook food by an open flame during camping and dining. In restaurants, some dishes may be reheated or thermally insulated with an open flame after being served. Solid alcohol is commonly used in the prior art, it is directly lighted after being put in a small metal canister, and the open flame is put at the bottom of an appliance. As the metal canister is open and the alcohol is prone to volatilization, it requires frequent replenishment of fuel. A liquid fuel can is provided in the prior art, which has better sealing performance and uses safer liquid fuel, such as Chinese Patent Application for Utility Model No. CN2591422Y, with its patent No. ZL02292646.1, in which the fuel is packaged in the can body; an opening in communication with an inner cavity of the can body is disposed at the center of an upper cover; a wick is installed in a burner tip; a small segment of the upper end of the wick protrudes out of the burner tip; a protective cover made of a plastic material covers the burner tip; and ignition is performed after removal of the protective cover, and the protective cover is used for preventing leakage or volatilization of the internal fuel.

The above solution has the following defects: 1) the protective cover and the structure for fixing the upper end of the wick are relatively large, and prone to collision; 2) the protective cover has insufficient strength, and is easy to be damaged in the process of long-term storage and transportation; and 3) in the event of leakage of the internal fuel, it is impossible to recover the fuel, leading to material waste and increased safety risks.

SUMMARY

The present application is intend to solve the above technical problems, and thus provides a fuel can, which has good sealing effect, is not easy to be damaged and may recover leaked fuel.

The present application adopts the following technical solution to solve the above problems.

A fuel can includes a can body, wherein the can body contains liquid fuel and a wick with a lower end immersed in the liquid fuel, and a top cover is provided at a top the can body, wherein the top cover includes a ring-pull cap and a sealing cap, the ring-pull cap consists of an outer ring and a tear-off piece, the outer ring is connected to an upper opening of the can body in a sealing manner, and the sealing cap is buckled at a top end of the outer ring; a tray is provide at an upper part of the can body, a periphery of the tray is connected to an inner wall of the can body in a sealing manner, and at least one fixing mouth for fixing an upper end of the wick is provided in a middle of the tray; the tray is further provided with an air hole and a reflux hole, the air hole is provided with a raised lip protruding from an upper surface of the tray, and the reflux hole is provided with a raised lip protruding from a lower surface of the tray.

Compared with the related art, the present application using the above structure has the following beneficial effects:

1) Double caps are used for protection in the present application, and the can may be sealed and closed after initial opening, supporting repeated use; 2) the tray is used for fixing the wick, and is placed inside the can body, and the fixing mouth is small in size, so that the can body has a cylindrical shape, and is easy to containerize for transportation; 3) the opening of the fixing mouth is small and wraps around the wick, reducing volatilization of the material and keeping the flame uniform and lasting; 4) the air hole self-adjusts the pressure of the fuel cavity, avoiding explosion resulted from internal overheating of the fuel cavity during combustion; and 5) the reflux hole enables the leaked liquid fuel to flow back into the can, reducing contamination and material waste.

As a preferred option, a further technical solution of the above structure is as follows:

An annular support table is provided on the inner wall of the can body, and an annular groove is further provided on the inner wall of the can body above the annular support table along an outer circumference of the annular support table; the periphery of the tray is located on a top surface of the annular support table, and tightly abuts against an interior of the annular groove.

The beneficial effects obtained by the above features are as follows: the tray in such a structure is convenient to be installed, good in sealing performance, and not easy to fall off, and stably supports the upper end of the wick.

The tray is an arc-shaped plate depressed in the middle.

The beneficial effect obtained by the above feature is as follows: this example facilitates rapid backflow of the liquid fuel leaked out of the tray into the can.

The fixing mouth includes a through hole formed in the tray, and three or four clamping pieces are fixedly connected to a circumference of the through hole, each clamping piece is in a shape of a fan, a central angle of the sector is provided upwards, and a middle of an arc-shaped edge of each fan is connected to a peripheral wall of the through hole, and two ends of each fan have fracture openings separated from the tray.

The beneficial effects obtained by the above features are as follows: the fixing mouth is formed by deformation of the original plate of tray, simple to manufacture and low in cost, and facilitates adjustment of the clamping force according to the thickness of the wick, providing good stability for fixing the wick.

The upper end of the can body is affixed to the lower end of the outer ring, and the upper end of the can bod and the lower end of the outer ring are synchronously rolled for fixing.

The beneficial effect obtained by the above feature is as follows: due to this structure, the stable connection of the top of the can and a good sealing performance are achieved.

The sealing cap is a plastic cap, and a periphery of the sealing cap is provided with a groove, and the outer ring is snapped and fixed in the groove.

The beneficial effect obtained by the above feature is as follows: the top cover in this example may seal the can body to prevent fuel leakage even without the ring-pull cap.

DETAILED DESCRIPTION OF THE EMBODIMENTS

Figure 1:
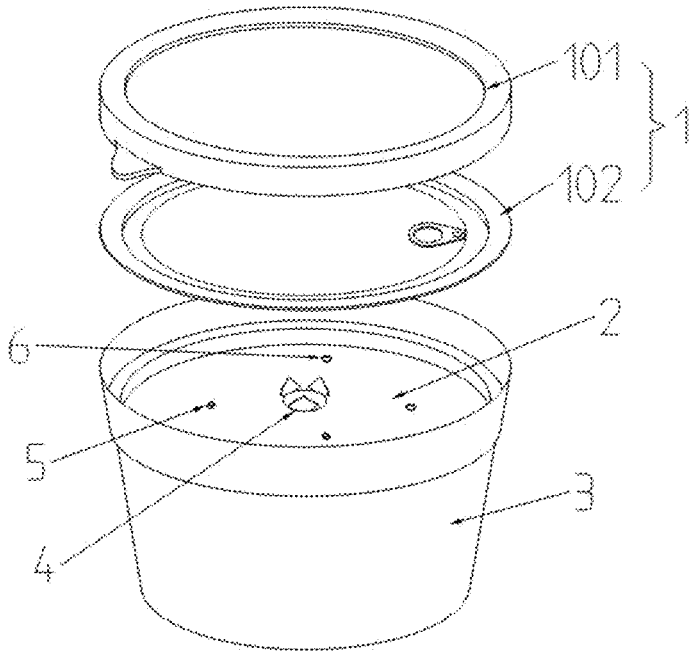
FIG. 1 is an integral structural view of a fuel can of the present application.
Figure 2:
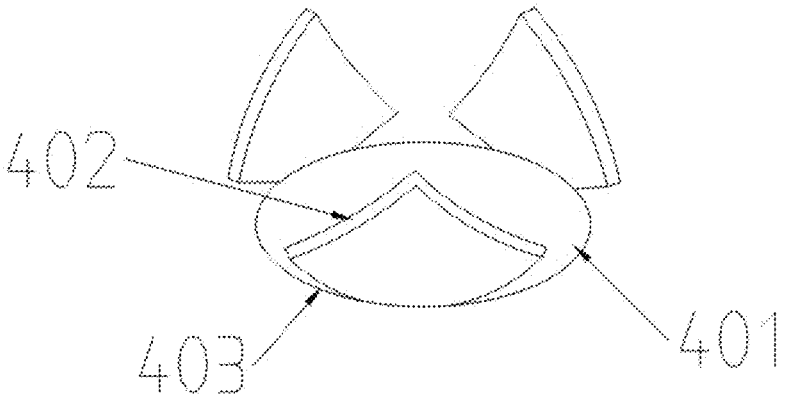
FIG. 2 is a structural view of a fixing mouth of the present application.

The present application will be further described with reference to embodiments, with the only purpose of better understanding the contents of the present application. Therefore, the given examples do not limit the protection scope of the present application.

Referring to FIG. 1 to FIG. 5, a fuel can provided by the present application includes a can body 3, which contains liquid fuel and a wick 7, a lower end of the wick 7 is immersed in the liquid fuel and a top cover 1 is provided at the top of the can body 3. The top cover 1 includes a ring-pull cap 102 and a sealing cap 101. The ring-pull cap 102 consists of an outer ring 1021 and a tear-off piece 1022, the outer ring 1021 is connected to the upper opening of the can body 3 in a sealing manner, and the sealing cap is buckled at the top edge of the outer ring 1021. A tray 2 is provided at an upper part of the can body 3, and a periphery of the tray 2 is connected to the inner wall of the can body 3 in a sealing manner, and at least one fixing mouth 4 for fixing the upper end of the wick 7 is provided in the middle of the tray 2. The tray 2 is further provided with an air hole 5 and a reflux hole 6. The air hole 5 is provided with a raised lip protruding from the upper surface of the tray 2, and the reflux hole 6 is provided with a raised lip protruding from the lower surface of the tray 2.

The wick 7 is a fiber wick 7 or a cotton wick 7. Three fixing mouths 4 are enough generally, and a single fixing mouth 4 is used for fixing a single wick 7.

Figure 3:
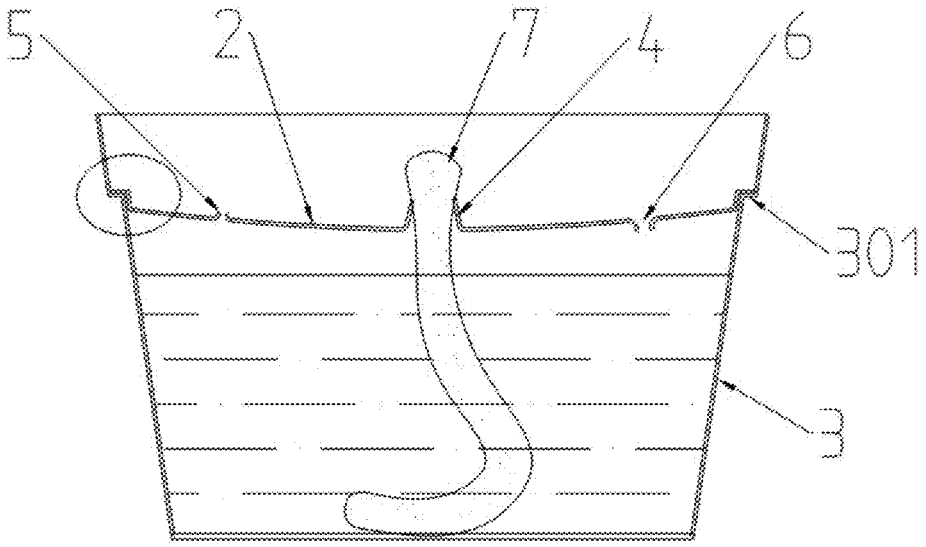
FIG. 3 is an integral structural perspective view of a can body of the present application.
Figure 4:
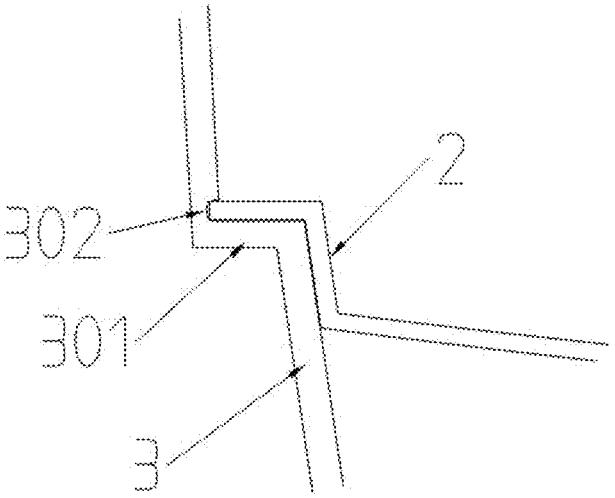
FIG. 4 is a structural view of the assembly of a tray and the can body of the present application.
Figure 5:
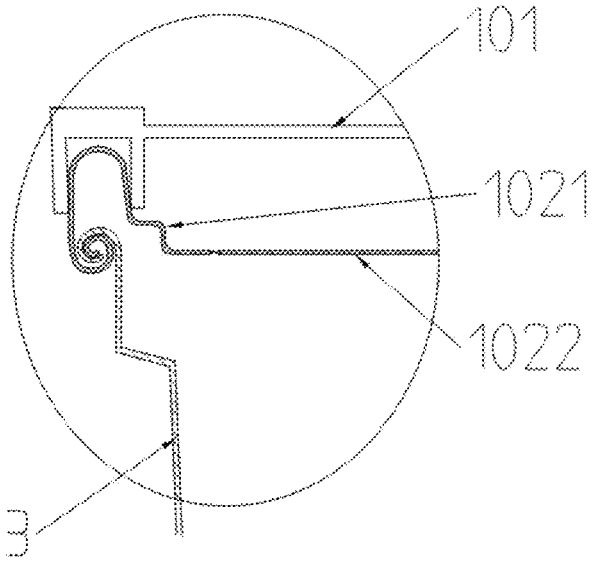
FIG. 5 is a structural view of the connection of the top of the can body of the present application.

As an option, the installation structure of the tray 2 is as follows: an annular support table 301 is provided around the inner wall of the can body 3, and an annular groove 302 is further provided on the inner wall of the can body 3 above the annular support table 301 along the outer circumference of the annular support table 301. A periphery of the tray 2 is located on the annular support table 301, and tightly abutted against the interior of the annular groove 301. Referring to FIG. 1 or FIG. 3, the can body preferably adopts a side wall having a cross section with slight inclination. The tray 2 is horizontally put into the can body 3 from the top, and is pushed downward by increased pressure to fall onto the top surface of the annular support table 301, meanwhile, by virtue of the diameter difference between the tray and the can body at this position, the tray tightly abuts against the interior of the annular groove 302, the shoulder of the tray 2 falls onto the annular groove 302, and the outer edge is clamped in the annular groove 302. In this embodiment, the height of the annular groove 302 matches the thickness of the tray 2, so that tight abutting between the tray 2 and the annular groove 302 is achieved, thereby forming a sealing fit with the inner wall of the can body 3, ensuring no fuel leakage out of the edge of the tray 2 occurs.

The fixing mouth 4 provided by the present application is designed as follows: the fixing mouth 4 includes a through hole 401 formed in the tray 2, and three or four clamping pieces 402 which are in the shape of a fan are fixedly connected to the circumference of the through hole 401. The central angle of the fan is set upwards, and a middle of the arc-shaped edge of each fan is connected to the peripheral wall of the through hole 401, and each fan has fracture openings 403 separated from the tray 2 at its two ends. The fixing mouth 4 is then formed by stamping by means of the deformation of the original plate of the tray, without preparation of other components. It is only required to stamp the board of the original tray to form corresponding openings, and then fold corner plates upwards for molding. A part of each fracture opening 403 is cut at the bottom of each corner plate to facilitate standing of the clamping piece 402. In a case where the clamping piece 402 is bent outwards, it may be possible to enlarge the fixing mouth 4 to fix a relatively thick wick 7, and in a case where the clamping piece 402 is pressed towards the middle, it may be possible to reduce the fixing mouth 4 to fix a relatively thin wick 7, so that the use and adjustment are both extremely convenient.

The air hole 5 is manufactured by punching the tray 2 from bottom to top, while the reflux hole 6 is manufactured by punching the tray 2 from top to bottom. A plurality of air holes 5 and reflux holes 6 are uniformly formed around the center of the tray 2, and optionally, they are arranged at intervals.

Both the air hole 5 and the reflux hole 6 are running-through holes, and can allow passage of air and liquid fuel in practice. Their difference lies in the fact that when the level of the liquid fuel leaked to the upper side of the tray 2 is below the raised lips of the air holes, refluxing can be achieved only through the reflux holes 6, while the air holes 5 can keep internal air ventilation, avoiding the case that all running-through holes are blocked by liquid to form a vacuum cavity to resist refluxing of the liquid fuel.

The function of allowing refluxing of the raw material in the present application has obvious advantages particularly in transportation. Specifically, it is inevitable to experience bumpiness and shaking during transportation, and the can body 3 is thus prone to tipping. The internal liquid fuel may leak into the cavity between the tray 2 and the ring-pull cap 102. However, by using the design in the present application, after the can body 3 is placed upright, the fuel can slowly leak back into the fuel cavity inside the can after a certain period of time. In this way, when the ring-pull cap 102 is opened for use, the surface of the tray 2 is still clean.

Optionally, the tray 2 is designed to be an arc-shaped plate depressed in the middle. When the fuel leaks on the surface of the tray 2, the fuel may quickly converge to the middle through the arc-shaped inclination, and then leak back into the can through the air holes 5 and the wick 7.

The upper end of the can body 3 is affixed to the lower end of the outer ring 1021, and they are subjected to rolled molding, so as to achieve the purpose of fixing. In this example, the upper and lower components (i.e., the upper end of the can body 3 and the lower end of the outer ring 1021) are connected by rolling together without adhesion, and can be rapidly manufactured on a machine at one time. Moreover, the connection formed after rolling is stable, and the sealing performance is relatively good. The can in the present application is made of iron or aluminum.

Optionally, the sealing cap is a plastic cap with a groove provided on its periphery, and the outer ring 1021 is snapped and fixed in the groove. The sealing cap may still seal the can body 3 after the ring-pull cap 102 is torn off, so as to prevent leakage and volatilization of the fuel.

The present application has the following beneficial effects:

1) Double caps are used for protection in the present application, and the can may be sealed and closed after initial opening, supporting repeated use; 2) the tray is provided in the can body, so that the can body has a cylindrical shape, and is easy to containerize for transportation; 3) the fixing mouth is small, reducing volatilization of the material and keeping the flame uniform and lasting; 4) the air hole self-adjusts the pressure in the can, avoiding explosion resulted from internal overheating of the fuel cavity during combustion; 5) the reflux hole enables the leaked liquid fuel to flow back into the can, reducing contamination and material waste; 6) an arc-shaped guiding shape for accelerating the convergence of liquid is designed, allowing fuel leaked out of the tray to flow back more quickly; and 7) the connections among the components in the present application are achieved without the help of other materials, and are wholly rigid connections, and the wholly metallic can body is resistant to high temperature, and is not prone to aging.

The above description is merely preferred feasible embodiments of the present application and does not limit the scope of the present application. Any equivalent variations made by using the contents of the description and accompanying drawings of the present application fall within the scope of the claims of the present application.

What is claimed is:

1. A fuel can, comprising a can body, wherein the can body contains liquid fuel and a wick with a lower end immersed in the liquid fuel, and a top cover is provided at a top the can body, wherein the top cover comprises a ring-pull cap and a sealing cap, the ring-pull cap consists of an outer ring and a tear-off piece, the outer ring is connected to an upper opening of the can body in a sealing manner, and the sealing cap is buckled at a top end of the outer ring; a tray is provide at an upper part of the can body, a periphery of the tray is connected to an inner wall of the can body in a sealing manner, and at least one fixing mouth for fixing an upper end of the wick is provided in a middle of the tray; the tray is further provided with an air hole and a reflux hole, the air hole is provided with a raised lip protruding from an upper surface of the tray, and the reflux hole is provided with a raised lip protruding from a lower surface of the tray;

wherein an annular support table is provided on the inner wall of the can body, and an annular groove is further provided on the inner wall of the can body above the annular support table along an outer circumference of the annular support table; the periphery of the tray is located on a top surface of the annular support table, and tightly abuts against an interior of the annular groove.

2. The fuel can according to claim 1, wherein the tray is an arc-shaped plate depressed in the middle.

3. The fuel can according to claim 1, wherein the fixing mouth comprises a through hole formed in the tray, and three or four clamping pieces are fixedly connected to a circumference of the through hole, each clamping piece is in a shape of a fan, a central angle of the sector is provided upwards, and a middle of an arc-shaped edge of each fan is connected to a peripheral wall of the through hole, and two ends of each fan have fracture openings separated from the tray.

4. The fuel can according to claim 1, wherein an upper end of the can body is affixed to a lower end of the outer ring, and the upper end of the can body and the lower end of the outer ring are synchronously rolled for fixing.

5. The fuel can according to claim 1, wherein the sealing cap is a plastic cap, and a periphery of the sealing cap is provided with a groove, and the outer ring is snapped and fixed in the groove.

* * * * *